US005796024A

United States Patent [19]

Stanwood

[11] Patent Number: 5,796,024

[45] Date of Patent: Aug. 18, 1998

[54] METHOD FOR INERTIAL BALANCING OF MUSICAL INSTRUMENT KEYBOARDS

[76] Inventor: David C. Stanwood, R.F.D. 340, Vineyard Haven, Mass. 02568

[21] Appl. No.: 794,431

[22] Filed: Feb. 5, 1997

Related U.S. Application Data

[60] Provisional application No. 60/011,119, Feb. 5, 1996.

[51] Int. Cl.[6] ..... G10C 3/12

[52] U.S. Cl. ..... 84/433; 84/438

[58] Field of Search ..... 84/433, 438, 439

[56] References Cited

U.S. PATENT DOCUMENTS 1,510,663 10/1924 Finnimore ..... 84/433

1,589,745 6/1926 Federle ..... 84/433

*Primary Examiner*—Michael L. Gellner

*Assistant Examiner*—Shih-yung Hsieh

*Attorney, Agent, or Firm*—John M. Brandt

[57] ABSTRACT

An improved method for the inertial balancing of a plurality of key assemblies having keysticks within a musical instrument keyboard wherein an individual front weight is predetermined for each stick, the method consisting of calibrating each of the keysticks to an identical selected front weight prior to installing the key leads to a preset pattern which result in the final individual front weight for each key assembly.

5 Claims, 1 Drawing Sheet

METHOD FOR INERTIAL BALANCING OF MUSICAL INSTRUMENT KEYBOARDS

CROSS REFERENCE TO RELATED APPLICATION

This application is a formal application based on the disclosure submitted as a provisional application entitled Pattern Positioning of Key Weights in Musical Instruments, Ser. No. 60/011,119 filed Feb. 5, 1996 by the same inventor.

BACKGROUND OF INVENTION

1. Field of Invention

The invention relates to the balancing of key mechanisms for musical instruments and more particularly relates to an improved multi-unit production method for achieving a final smoothed front weight for each of a plurality of key assemblies with original varying front weights.

2. Description of the Prior Art

The concept of balancing key mechanisms associated in clustered assemblies such as piano keyboards is the subject of U.S. Pat. No. 5,585,582 issued Dec. 17, 1996 to the present inventor. The general teaching of the patent is a detailed variety of key balancing methods all resulting in a keyboard in which the final front weight of each key meets a selected and predetermined specification. The weight specifications for the entire group of keys forming the keyboard are chosen to provide the player with a desired feel or touch and most often are in the form of a smooth declining progression from the lowest note to the highest. Achieving a particular result requires that each key assembly must be addressed individually and is of course highly dependent upon the manufacturing methods by which key assemblies are made.

In the manufacture of pianos for example, all of the hammers are cut or sliced from a single pre-formed piece of felt and wood, and attached to a standard shank. Similarly, all of the key sticks are cut from a single board, each stick having an appropriate bend as seen from the top according to its position on the keyboard. The key is connected to and activates the hammer through a mechanical assembly called the wippen which transmits the force of the struck key to a force on the hammer and provides for release of the hammer to return the assembly to its initial position after a note is played.

The methods of the aforesaid patent particularly take into account the effect of the hammer strike weight, the wippen weight and the front weight of the key stick and achieve the final desired front weight when key leads are added to the key stick to achieve a particular measurement on a scale on which the key stick assembly has been placed.

The end step in the methods of the prior art described above is therefore to separately balance each key stick on a scale jig to a selected front weight which will vary from key to key in a chosen progression. In a piano for example this presents an assembler with the arduous task of meeting upwards of eighty eight separate specifications according to a table of figures generated by the designer.

The present invention provides an improved method whereby each key stick in an entire keyboard is balanced to a single or uniform calibration weight thereby allowing the installation of one or more preselected key leads for each key stick without the need for further balancing or the consultation of a varying front weight table for each keystick. As will be seen the invention disclosed herein is particularly applicable to the repetitive production of many instruments of a particular design.

SUMMARY OF THE INVENTION

In the invention, the methodology of the above described patent is employed to specify a set of weight characteristics for each key assembly in a keyboard set which characteristics are derived from the designer's experience coupled with the method and calculations discussed in detail in that patent. Each key will therefore have a final desired front weight assigned by the design process which is to be achieved by the off action balancing process, i.e., the addition of key leads as described in the patent. As these final front weights are known and specified they can be pre supplied for installation without individual balancing if the weight of the keystick for each key is a known fixed quantity. The fixed keystick weight is then subtracted from the desired specified front weight to provide a specified weight which may simply be installed without further adjustment.

This may be accomplished by balancing or calibrating each key stick to a single desired and selected uniform calibration front weight prior to installing the key leads which will achieve the specified and varying front weight for each.

The calibration front weight may be chosen for example as the average unbalanced front weight of a key stick for a particular manufacturer and board of material from which the keys are cut. This front weight will on average, for a particular manufacturer, remain constant for a substantial period of time over many instruments of the same design until there is a change in design or a change in the material used to construct the key.

The features and objects of the invention will now be more fully understood from the drawings and description of the preferred embodiment which follows:

DESCRIPTION OF THE PREFERRED EMBODIMENT

Figure 1:
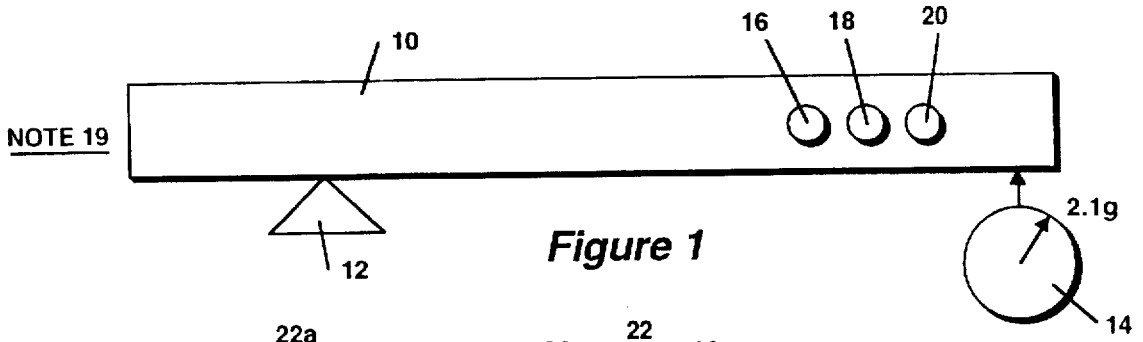
FIG. 1 is a schematic illustration of a key stick in a first state of the method of the invention.

The following are the method steps of the invention for a typical piano keyboard. It will be understood that the technique may be applied in a similar fashion to any other kind of musical instrument keyboard as well.

Step 1. Determine a set of keystick front weight specifications for each key assembly in accordance with the methodology of the prior art as described above.
Example: Table 1, column "FrontWtSpec"

Step 2. Determine the uniform calibration front weight as a constant value which is for example close to the average front weight of the keysticks, or sections of keysticks, prior to installation of the key leads.
Example: Table 1, Column "Calibration Front Wt"
This weight is, for example, a numerical average of a set of typical unbalanced keystick front weights for a selected instrument model, manufacturer and material.

Example: Table 1, Column "Unbalanced FrontWt"

Step 3. Determine positions for key leads of a specific weight, to be mounted in each key at marked positions in a pattern such that their effect on the front weight, when mounted in the key, is equal to the front weight specification minus the calibration front weight. The effect that these patterned key leads have on the front weight is called the module front weight.

Example: Table 1, Column "Module Front Weight"

The key leads that make the module front weight are called the module key leads.

Step 4. Drill mounting holes in the side of the keys for the mounting the module key leads at their patterned positions. In this step the holes are drilled but the module key leads are not yet installed in their mounting holes.

Step 5. Prior to installing the module key leads, each key is placed on a weighing jig. A calibration key lead, (or leads) is placed on top of the key and slid back and forth until a position is found were the front weight of the key is equal to the calibration front weight. The position of the key lead is marked, a hole drilled at the mark, and the calibration key lead is mounted in the hole, thereby making the front weight of the key (at this stage of the process) equal to the calibration front weight.

TABLE 1

| Note | Unbalanced FrontWt (Typical) | FrontWtSpec (Prior Art) | ModuleFrontWt (The Invention) | CalibrationFront-Wt (The Invention) |
|---|---|---|---|---|
| 1 | 5.6 | 39.8 | 35.8 | 4.0 |
| 2 | 2.7 | 39.4 | 35.4 | 4.0 |
| 3 | 4.0 | 39.1 | 35.1 | 4.0 |
| 4 | 2.8 | 38.8 | 34.8 | 4.0 |
| 5 | 6.5 | 38.5 | 34.5 | 4.0 |
| 6 | 6.5 | 38.1 | 34.1 | 4.0 |
| 7 | 4.1 | 37.8 | 33.8 | 4.0 |
| 8 | 2.0 | 37.5 | 33.5 | 4.0 |
| 9 | 4.9 | 37.2 | 33.2 | 4.0 |
| 10 | 3.1 | 36.8 | 32.8 | 4.0 |
| 11 | 8.1 | 36.5 | 32.5 | 4.0 |
| 12 | 2.0 | 36.2 | 32.2 | 4.0 |
| 13 | 2.9 | 35.9 | 31.9 | 4.0 |
| 14 | 3.7 | 35.6 | 31.6 | 4.0 |
| 15 | 4.6 | 35.2 | 31.2 | 4.0 |
| 16 | 4.1 | 34.9 | 30.9 | 4.0 |
| 17 | 2.2 | 34.6 | 30.6 | 4.0 |
| 18 | 4.4 | 34.3 | 30.3 | 4.0 |
| 19 | 2.1 | 33.9 | 29.9 | 4.0 |
| 20 | 2.2 | 33.6 | 29.6 | 4.0 |
| 21 | 1.1 | 33.3 | 29.3 | 4.0 |
| 22 | 3.7 | 33.0 | 29.0 | 4.0 |
| 23 | 6.8 | 32.7 | 28.7 | 4.0 |
| 24 | 5.9 | 32.3 | 28.3 | 4.0 |
| 25 | 3.9 | 32.0 | 28.0 | 4.0 |
| 26 | 3.8 | 31.7 | 27.7 | 4.0 |
| 27 | 2.4 | 31.4 | 27.4 | 4.0 |
| 28 | 2.2 | 31.0 | 27.0 | 4.0 |
| 29 | 3.9 | 30.7 | 26.7 | 4.0 |
| 30 | 7.3 | 30.4 | 26.4 | 4.0 |
| 31 | 1.8 | 30.1 | 26.1 | 4.0 |
| 32 | 2.9 | 29.8 | 25.8 | 4.0 |
| 33 | 4.9 | 29.4 | 25.4 | 4.0 |
| 34 | 7.6 | 29.1 | 25.1 | 4.0 |
| 35 | 7.0 | 28.8 | 24.8 | 4.0 |
| 36 | 3.5 | 28.5 | 24.5 | 4.0 |
| 37 | 0.7 | 28.1 | 24.1 | 4.0 |
| 38 | 4.0 | 27.8 | 23.8 | 4.0 |
| 39 | 6.9 | 27.5 | 23.5 | 4.0 |

TABLE 1-continued

| Note | Unbalanced FrontWt (Typical) | FrontWtSpec (Prior Art) | ModuleFrontWt (The Invention) | CalibrationFront-Wt (The Invention) |
|---|---|---|---|---|
| 40 | 5.6 | 27.2 | 23.2 | 4.0 |
| 41 | 6.5 | 26.9 | 22.9 | 4.0 |
| 42 | 2.0 | 26.5 | 22.5 | 4.0 |

In practice, the manufacture of balanced keyboards using the method of the invention therefore requires four basic steps for each key:

Step 1. Mark and drill the holes for mounting the module front key leads to the preset pattern.

Step 2. Place the key stick on the weighing jig and mark the position of the calibration key lead as determined by moving the calibration key lead back and forth to achieve the selected calibration front weight.

Step 3. Drill a hole at the marked position for mounting the calibration key lead.

Step 4. Install the calibration and module key leads into their respective mounting holes.

The invention will be further understood by reference to the Figures. Take, for example, the set of numbers for note 19 of the table. It has been determined by the methods of the prior art that a desired front weight specification for that key should be 33.9 grams and that the average unbalanced front weight for this particular design and manufacturing cycle is 4.0 grams. This key as balanced on pivot 12 and weighed by scale 14 is found to weigh 2.1 grams. It has further been determined that if a combination of selected key leads are placed in the keystick at predrilled holes 16, 18, and 20 with an effective scale weight of 29.9, the correct front weight of 33.9 will be achieved if the key has an effective calibration front weight of 4.0. This determination can be accomplished by starting with a key of the calibration front weight for each note and measuring for each note the weight and placement of the appropriate set of key leads needed to meet the predetermined front weight specification.

Figure 2:
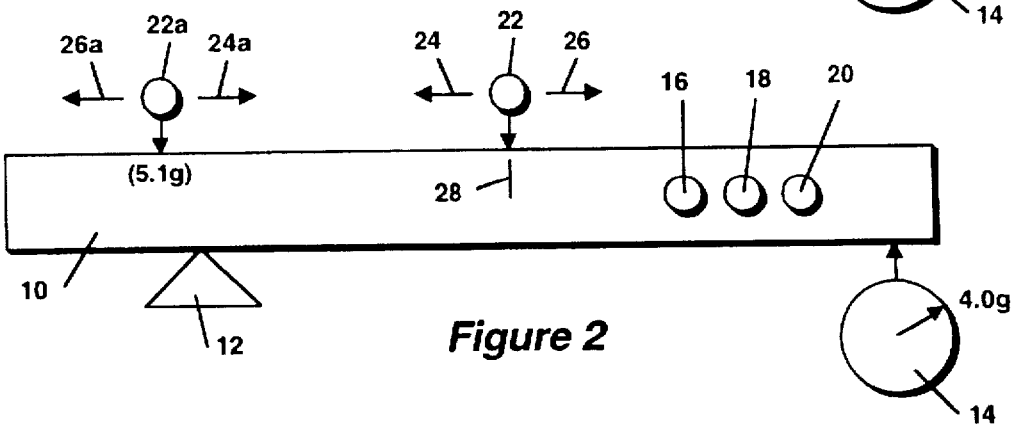
FIG. 2 is a schematic illustration of a key stick in a second state of the method of the invention.

Referring next to FIG. 2, a calibration key lead 22 is placed on the key and slid toward the pivot, arrow 24, or away from the pivot, arrow 26, until the desired uniform calibration front weight of 4.0 grams is achieved. Note that if the key produced by the manufacturing process had weighed more that 4.0 grams, 5.1 for example, the calibration key lead 22*a* would be placed on the back side of the key to achieve the desired calibration front key weight of 4.0 grams. The determined position is then marked at 28. Position 28 will normally be different from key to key due to natural variation in wood density and thickness of the saw cuts used in making each key.

Figure 3:
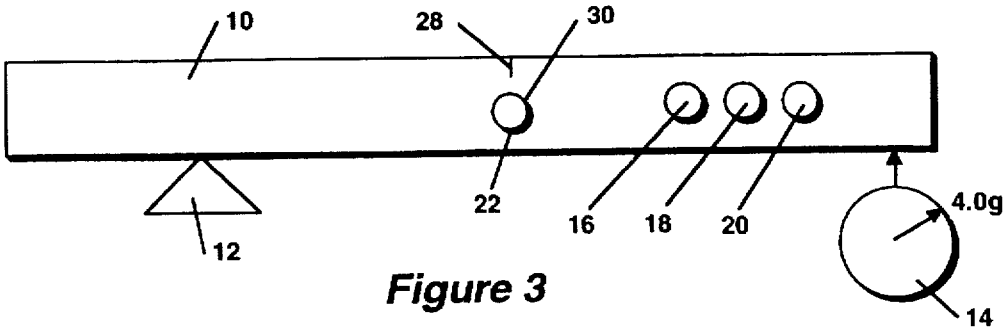
FIG. 3 is a schematic illustration of a key stick in a third state of the method of the invention.

FIG. 3 illustrates the key now calibrated to the desired calibration front weight of 4.0 grams, calibration key lead 22 having been placed in hole 30, drilled for the purpose at mark 28.

Figure 4:
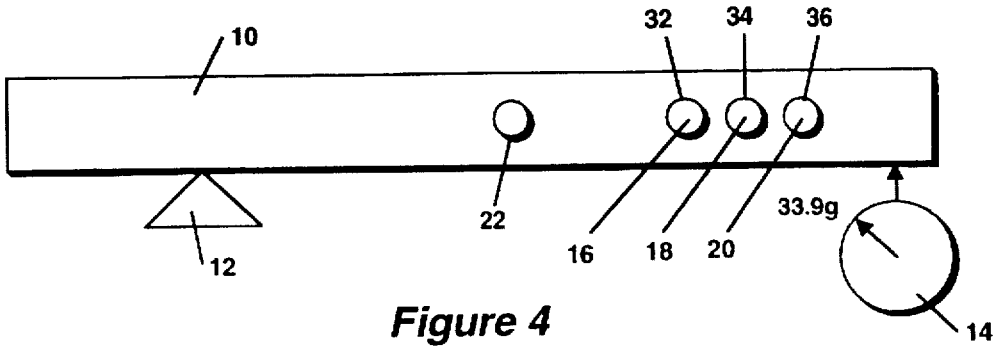
FIG. 4 is a schematic illustration of a key stick in the finished state of the method of the invention.

FIG. 4 shows a finished key with predetermined key leads 32, 34, and 36 installed in predrilled holes 16, 18, and 20 respectively. As will be seen, the selected front weight specification of 33.9 grams for note 19 has been achieved by balancing the key 10 with a single calibration key lead to a single calibration front weight specification which remains constant for all or a selected portion of the notes on the keyboard. It will be appreciated therefore that rather than requiring a keyboard technician to balance each separate key to a separate front weight with separate key leads in differing positions, perhaps two or three per key, a single weight may be used to balance to a single specification for all of the keys so selected on the keyboard. The method of the invention therefore presents a means where not only time will be saved by the elimination of tedious balancing to separate specifications for each key, but accuracy will be increased by the use of a uniform balance specification which eliminates the confusion attendant to, for a piano, the reading and following of up to eighty-eight different weight balance determinations.

The scope of the invention is accordingly defined by the following claims:

What is claimed is:

1. In the method of balancing key assemblies for musical instrument keyboards having a plurality of said assemblies each of said assemblies having a keystick, each of said assemblies relating to a note of the instrument wherein a specified keystick front weight is determined for each of said key sticks, the improvement which comprises the steps of:

specifying a uniform calibration keystick front weight for a selected portion of said keyboard;

selecting and determining the position of at least one appropriate module key lead in each of said keysticks, said module key lead arranged to produce said specified front weight for each of said key sticks when added to said uniform calibration front weight;

drilling a mounting hole for each of said module key leads in each of said key sticks;

placing the key stick on a front weight measuring jig;

adding and positioning a calibration key lead to each of said key sticks to produce said uniform calibration front stick weight;

drilling a mounting hole for each of said calibration key leads;

installing the appropriate calibration key leads and module key leads for each of said key sticks to achieve said specified front weight for each of said key sticks.

2. The method of claim 1 wherein the uniform calibration front weight is specified as the average weight of all of said keysticks in said selected portion of said keyboard for a selected design and manufacturer.

3. The method of claim 1 wherein said front weights are determined for all keysticks by balancing each of said keysticks on a pivot at a uniform position, placing a scale at a uniform position at the front of each of said keysticks, and reading said scale.

4. The method of claim 3 wherein said calibration key lead is placed forward of said pivot.

5. The method of claim 3 wherein said calibration key lead is placed rearward of said pivot.

* * * * *